US009308769B1

(12) United States Patent
Lau

(10) Patent No.: US 9,308,769 B1
(45) Date of Patent: Apr. 12, 2016

(54) NOTE AND CLIP

(71) Applicant: Janet K. Lau, Union City, CA (US)

(72) Inventor: Janet K. Lau, Union City, CA (US)

( * ) Notice: Subject to any disclaimer, the term of this patent is extended or adjusted under 35 U.S.C. 154(b) by 0 days.

(21) Appl. No.: 13/831,118

(22) Filed: Mar. 14, 2013

Related U.S. Application Data

(60) Provisional application No. 61/652,118, filed on May 25, 2012.

(51) Int. Cl.
*G09F 3/16* (2006.01)
*B42F 21/06* (2006.01)
*B42F 1/00* (2006.01)

(52) U.S. Cl.
CPC ..... *B42F 21/06* (2013.01); *B42F 1/006* (2013.01)

(58) Field of Classification Search
CPC ..... B42F 21/06; B42F 1/006
USPC ..... 40/657, 658, 666; D19/65; 24/67.5, 565
See application file for complete search history.

(56) References Cited

U.S. PATENT DOCUMENTS

| | | | | |
|---|---|---|---|---|
| 216,058 | A * | 6/1879 | Potter | 40/658 |
| 4,572,380 | A * | 2/1986 | Langwell | 211/57.1 |
| 5,481,784 | A * | 1/1996 | Sinaiko | 24/67.9 |
| 7,857,127 | B2 * | 12/2010 | Lau | 206/223 |
| 8,397,410 | B1 * | 3/2013 | Lau | 40/666 |
| 8,459,451 | B2 * | 6/2013 | Lau | 206/223 |

* cited by examiner

*Primary Examiner* — Joanne Silbermann
(74) *Attorney, Agent, or Firm* — Aka Chan LLP

(57) ABSTRACT

A tabbed note includes a note sheet or card having an opening and a binder clip. A binder clip is inserted through the opening and positioned to block the opening from a front view of the tabbed note. In an implementation, a bottom edge of the binder clip clips to a contact point on the card below the slit. A length of the card above the contact point is longer than a length of the handles of the binder clip.

20 Claims, 14 Drawing Sheets

Figure 22A
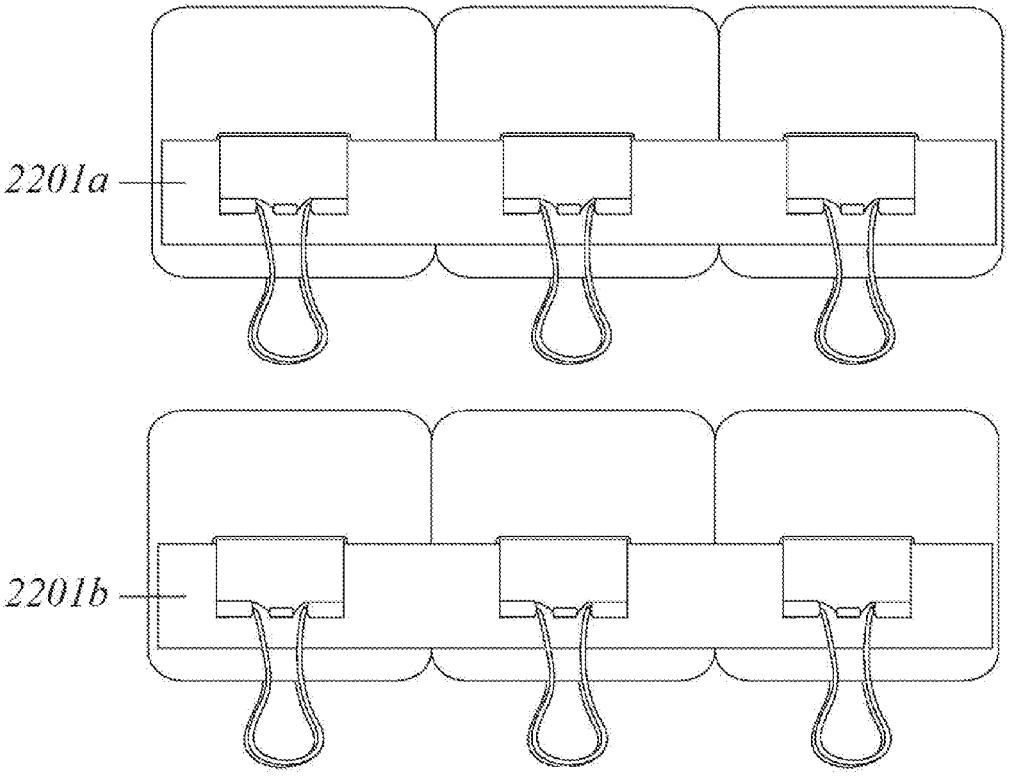
Figure 22B
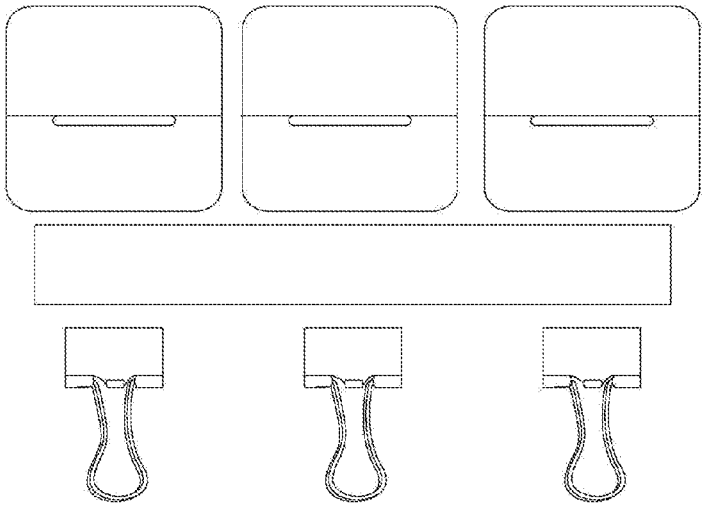
Figure 23A
Figure 23B
Figure 23C

Figure 26A
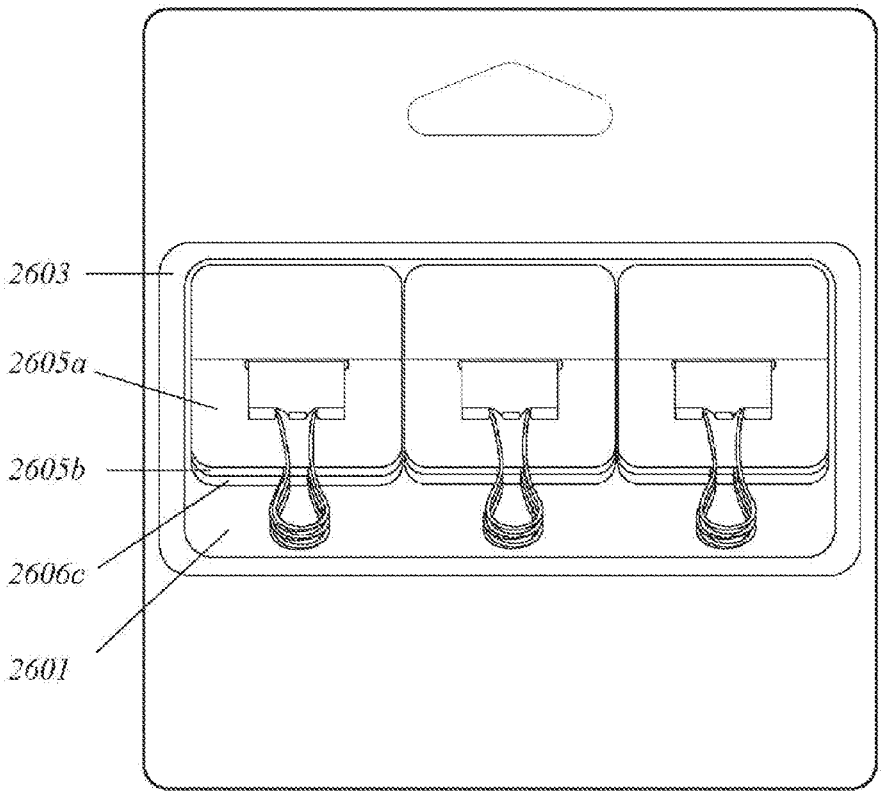
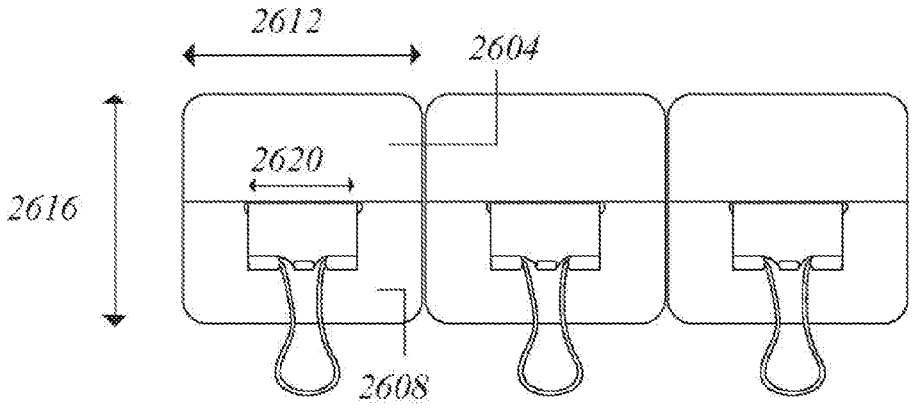
Figure 26B

Figure 27A
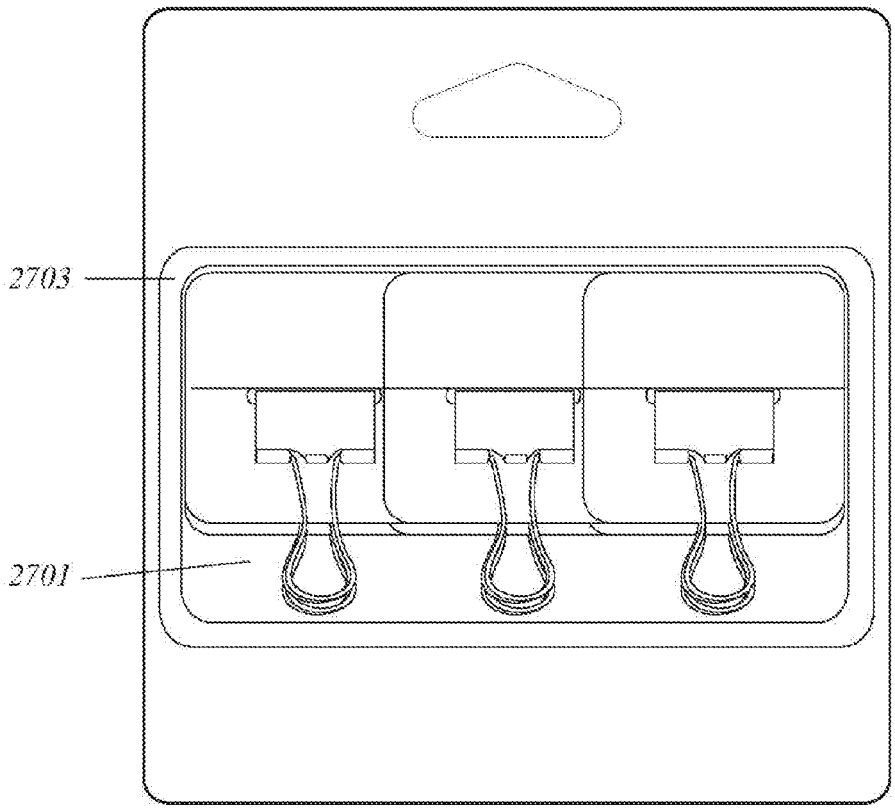
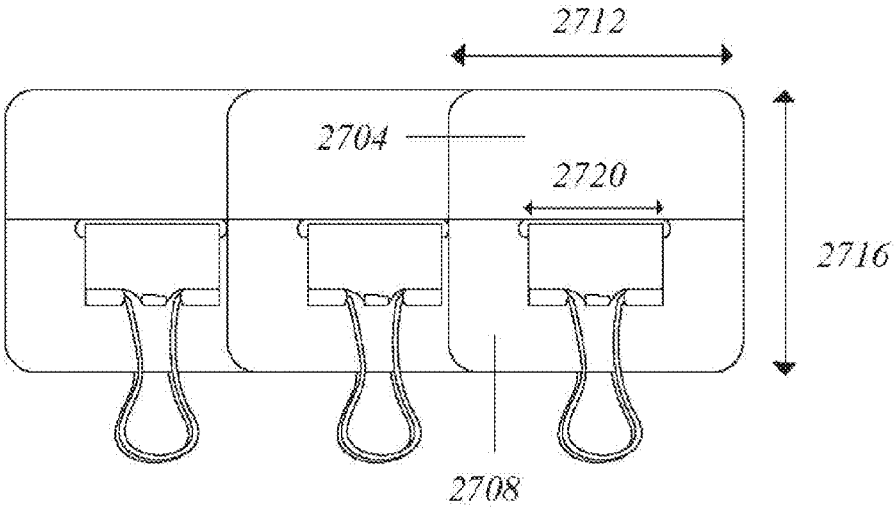
Figure 27B

Figure 28A
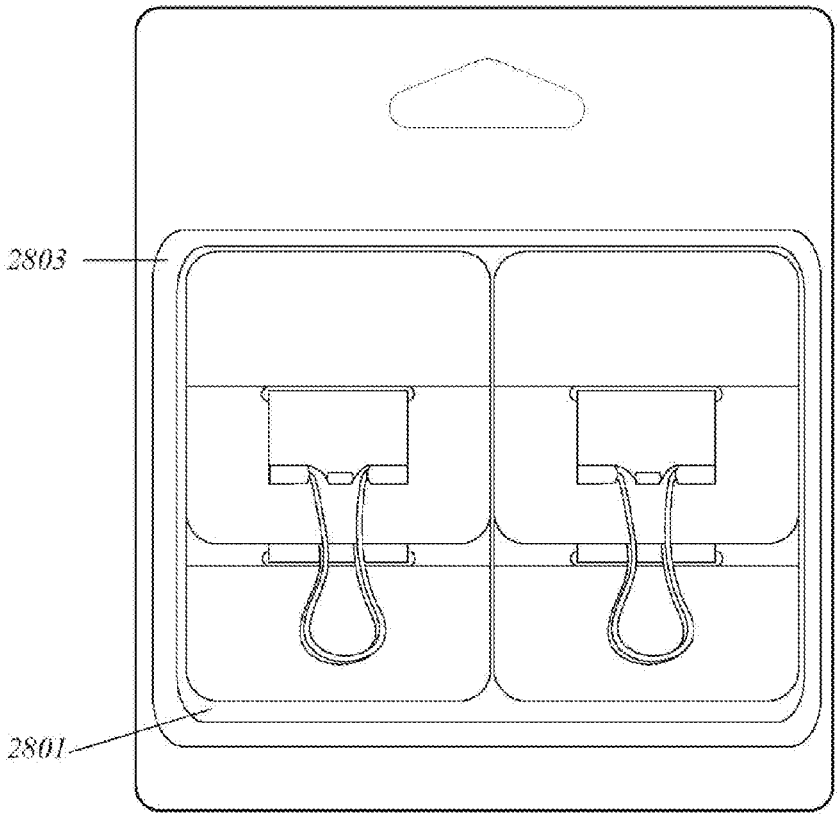
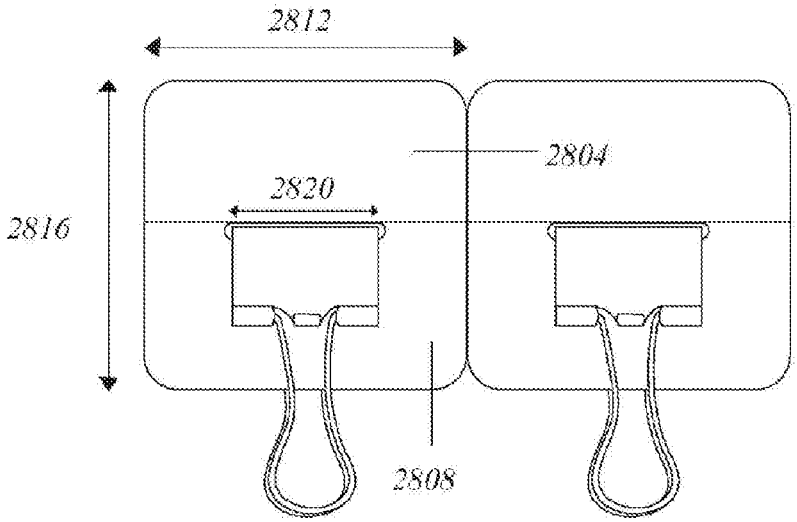
Figure 28B

NOTE AND CLIP

CROSS-REFERENCE TO RELATED APPLICATIONS

This application claims the benefit of U.S. patent application 61/652,118, filed May 25, 2012, which is incorporated herein by reference along with all other references cited in this application.

BACKGROUND OF THE INVENTION

The present invention relates generally to providing tabs which may be readily clipped on and unclipped from one or more sheets of paper. More particularly, the present invention relates to a tab section and a fastener (e.g., binder clip) that enables the grouping of one or more sheets of paper.

Despite great strides and advances in electronic technology, the birth of the Internet, and continued promises of the paperless office, paper remains important to the functioning of society and business today. Using paper is familiar, easy, reliable, and relatively inexpensive. With paper comes the need to organize and manage the growing mountains of paper better. Some of the most successful inventions in human history are tools or devices to manage paper better: Some well-known examples that quickly come to mind include the paper clip, binder clip, staple, stapler, file folder, binder, and many others.

Given a mountain of papers, some of the papers may be more important than other papers in the mountain, or groups of papers may have a different priority than other groups in the mountain. It would be very time consuming if one were to start from the beginning each time he or she were searching for a particular piece of paper. Therefore, to organize one or more sheets of paper such that specific sheets of paper may be readily identified, tabbed folders may be used. An individual may label folders to essentially provide labels for any sheets of paper contained therein. By way of example, when papers are to be separated into high priority and low priority groups, the tab portion of one folder may be labeled "high priority" and used to hold high priority papers, while the tab portion of another folder may be labeled "low priority" and used to hold low priority papers. Additional descriptions or notations pertaining to the contents of the folders may be printed or written directly onto the folders.

While the use of tabbed folders in the organization of papers is effective, the use of tabbed folders is not always desirable. Tabbed folders may be bulky, and if multiple folders are needed to organize papers, the amount of bulk added by the tabbed folders may be cumbersome. In addition, the need to open tabbed folders to view the contents of the folders may prove to be inconvenient.

Tabs or labels may be provided directly on sheets of paper to allow for the efficient filing of the sheets of paper. For example, a label may be positioned and glued over a paper clip. When the paper clip is secured to one or more sheets of paper, the label may be used to effectively label the sheets of paper when a printed card is received within the label. While such a label may be effective in allowing sheets of paper to be organized, having to remove a printed card held within the label when the text on the printed card is no longer relevant may be inefficient. Further, the label and paper clip assembly does not allow for additional notes regarding the sheets of paper held by the assembly to be made thereon.

Post-it® notes, which are available from 3M Incorporated of St. Paul, Minn., may be used to provide tabs for a sheet or sheets of paper, and are reusable. Post-it notes may be erased, as well as readily removed and reused. Despite the success of Post-it notes, there are shortcomings such as the inability to secure multiple papers together and not necessarily reliable and substantial in all circumstances. For example, Post-it notes are sometimes too easily removable, even by accident. Over time, Post-it notes may simply loose their adhesiveness.

Though a Post-it note may be positioned on a sheet of paper such that a portion of the Post-it note extends above an edge of the sheet of paper to effectively form a tab while a portion of the Post-it note that does not extend above the edge may serve to allow notes to be made thereon, the tab is relatively flimsy. Hence, the tab portion of a Post-it note used to form a tab may be accidentally bent such that any writing on the tab portion is obscured. In addition, a Post-it note may relatively easily become detached from a sheet of paper to which it is affixed, and is not arranged to secure multiple sheets of paper together.

Therefore, what is needed is a method and an apparatus which is relatively easy to reuse, and allows one or more sheets of paper to be securely tabbed. That is, what is desired is a tab arrangement which is reusable, secures one or more sheets of paper, and allows notes in addition to notations on a tab to be written thereon.

BRIEF SUMMARY OF THE INVENTION

A tabbed note includes a note sheet having an opening and a binder clip. A binder clip is inserted into the opening and positioned to block the opening from a front view of the tabbed note. The note sheet may be made from paper, card stock, fiberboard, plastic, polymer, a wood-based material, a petroleum-based material, a recycled material, a composite material, or other material.

In an implementation, a card or a small piece of paper material that includes a tab portion may be attached to the sheet of paper using fastener (e.g., binder clip) to effectively enable the sheet of paper to be tabbed. When the card is fastened to the sheet of paper, the tab portion extends above or beyond an edge of the sheet of paper. Such a tab portion may be written on to enable the sheet of paper to be labeled, while the remainder of the card may be used for writing notes.

In an implementation, a method for forming a tabbed note assembly includes obtaining a body with an opening and slits or slots defined therein, obtaining a fastener, and positioning the fastener with respect to the body. The fastener (e.g., binder clip) is positioned such that a first portion of the fastener is on one side of the body while a second portion of the fastener is on another side of the body. In an embodiment, the fastener is a paper clip or a binder clip.

A tabbed note assembly includes at least one piece of a paper product that has a first side, a second side, a tab portion, and a note portion. The paper product has one opening. The assembly also includes a fastener (e.g., binder clip) that is disposed in the one opening.

When the fastener (e.g., binder clip) is disposed in the one opening, the fastener contacts both the first side and the second side of the paper product. In one embodiment, the paper product has a polygonal shape.

Further, a tabbed note of the invention may be clipped to a single piece of paper in a secure, but removable manner. Before or while the tabbed note it attached, a user may write on the tabbed portion. The fastener portion of the tabbed may be reusable. For example, the note or paper portion (which has an opening or hole in a specific embodiment) of the tabbed note may be removed and a replacement paper portion (with a similar opening or hole) may be used with the same fastener.

Other objects, features, and advantages of the present invention will become apparent upon consideration of the following detailed description and the accompanying drawings, in which like reference designations represent like features throughout the figures.

BRIEF DESCRIPTION OF THE DRAWINGS

FIGS. 22A-B show specific implementations of a strip for attaching a series of tabbed note assemblies.

FIGS. 23A-C show a more detailed view of the strip and tabbed note assembly.

FIGS. 26A-B show a specific implementation of a tabbed note assembly.

FIGS. 27A-B show an additional specific implementation of a tabbed note assembly.

FIGS. 28A-B show an additional specific implementation of a tabbed note assembly.

DETAILED DESCRIPTION OF THE INVENTION

Figure 1A:
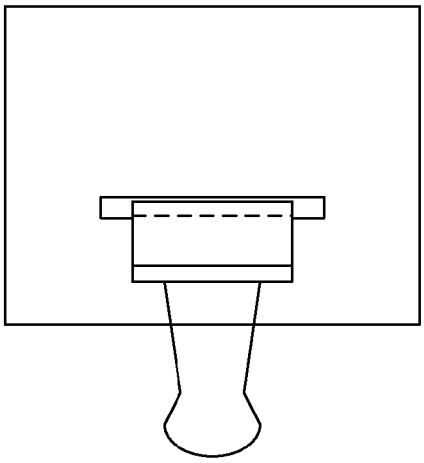
FIG. 1A shows a tabbed note assembly.

FIG. 1A shows a tabbed note assembly in accordance with an embodiment of the present invention. The tabbed note assembly includes a tabbed note and a fastener.

The tabbed note includes an opening through which the fastener may be inserted (more details on the opening below). The fastener is arranged to enable the tabbed note assembly to be fastened to or otherwise attached to a sheet of paper or paper-based product or a document. The tabbed note assembly may also be fastened to other items such as, for example, cardboard, wood, book or binder cover, folder, plastic, polymer, card stock, leather, fabric, or another type of material that can be written on or attached to, and combinations of these.

Figure 1B:
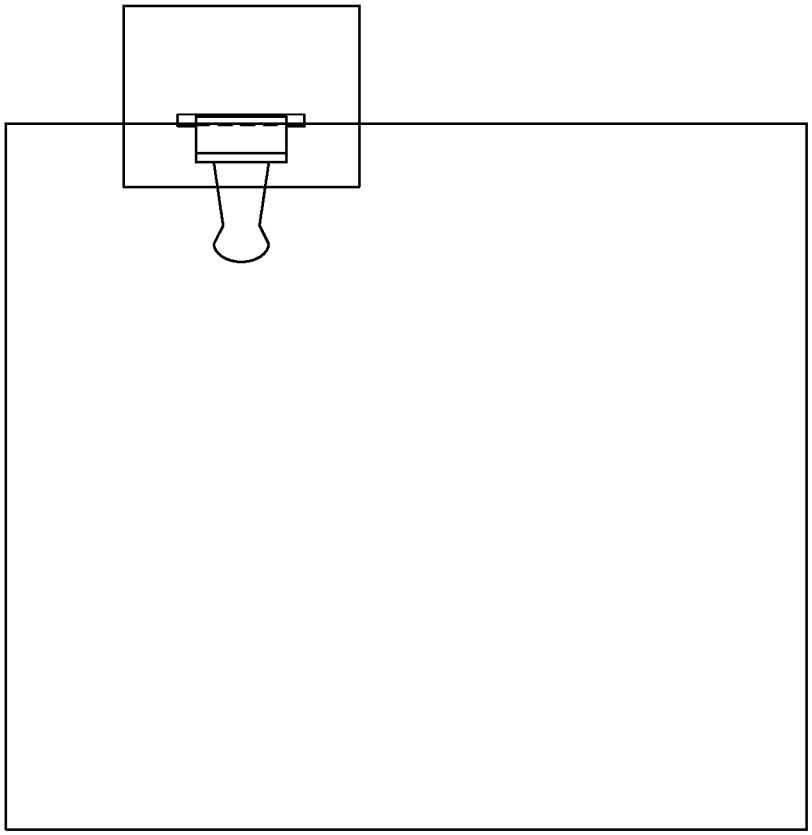
FIG. 1B shows the tabbed note assembly fastened to a sheet of paper.

FIG. 1B shows the tabbed note assembly fastened to a sheet of paper in accordance with an embodiment of the present invention. The tabbed note may be attached to the sheet of paper using the fastener.

Figure 2:
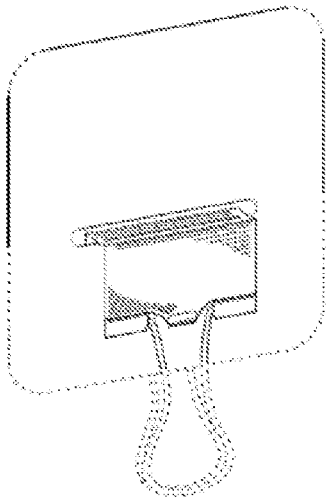
FIG. 2 shows a perspective view of a tabbed note assembly.

In an embodiment, the invention is an integrated tabbed note and binder clip. FIG. 2 shows a perspective view of a specific implementation of a tabbed note assembly in accordance with an embodiment of the present invention. The tabbed note assembly includes a tabbed note and a binder clip. The binder clip has at least two handles or clasps positioned in a first or downward position. When the handles or clasps are in the downward position, the tabbed note assembly can be more easily attached to a sheet of paper.

Figure 3:
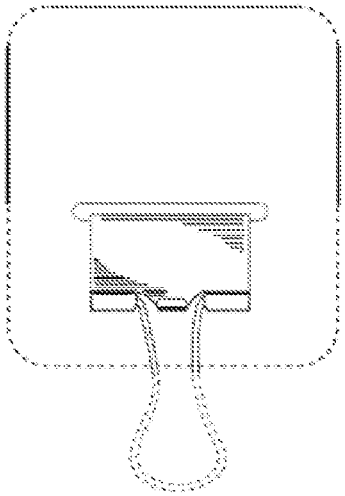
FIG. 3 shows a front view of the tabbed note assembly.

FIG. 3 shows a front view of the tabbed note assembly.

Figure 4:
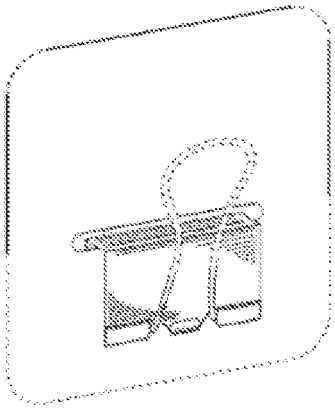
FIG. 4 shows another perspective view of the tabbed note assembly with handles or clasps positioned in an upward position.

FIG. 4 shows another perspective view of the tabbed note assembly. The clasps are positioned in a second or upward position. In an implementation, the second position is substantially opposite from the first position.

Figure 5:
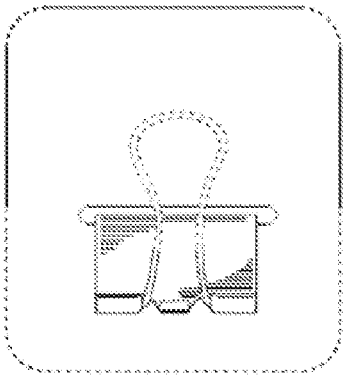
FIG. 5 shows a front view of the tabbed note assembly with handles or clasps positioned in an upward position.

FIG. 5 shows a front view of the tabbed note assembly with the clasps positioned in an upward position.

Figure 6:
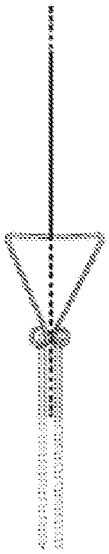
FIG. 6 shows a side view of the tabbed note assembly with handles or clasps positioned in a downward position.

FIG. 6 shows a side view of the tabbed note assembly in a closed, or clamped, position with clasps positioned in a downward position. The binder clip is clasped to the tabbed note. In the closed position, sides of the binder clip contact front and back sides of the tabbed note. The clasps can extend beyond a bottom edge of the tabbed note in the closed position.

Figure 7:
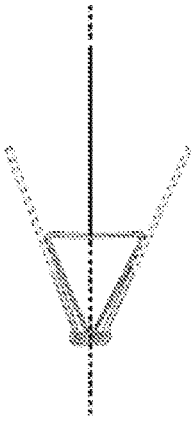
FIG. 7 shows a side view of the tabbed note assembly with clasps positioned in an upward position.

FIG. 7 shows a side view of the tabbed note assembly with clasps positioned in an upward position.

Figure 8:
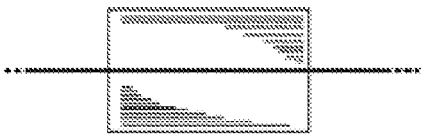
FIG. 8 shows a view of the tabbed note assembly from a top edge of the note.

FIG. 8 shows a top edge view of the tabbed note assembly.

Figure 9:
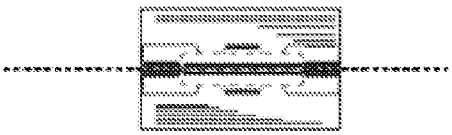
FIG. 9 shows a view of the tabbed note assembly from a bottom edge of the note.

FIG. 9 shows a bottom edge view of the tabbed note assembly.

Figure 10:
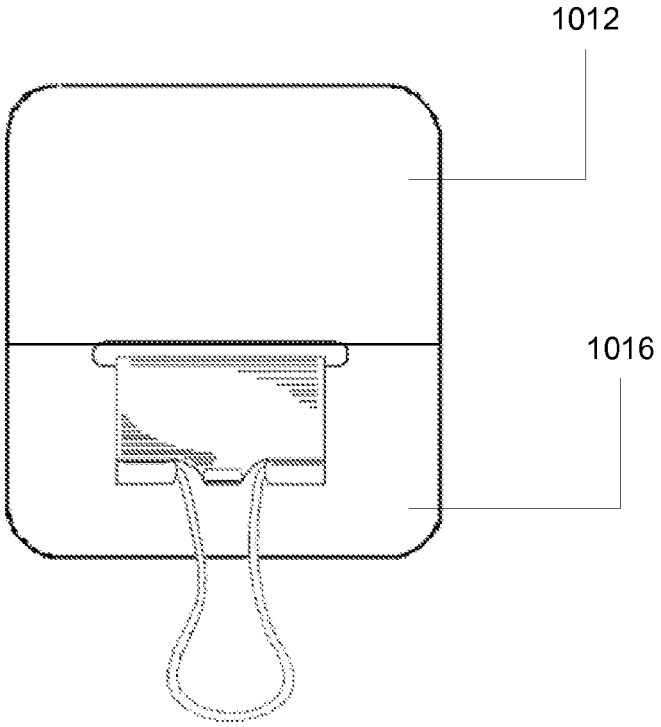
FIG. 10 shows a tabbed note assembly having a tabbed note and fastener.

FIG. 10 shows a tabbed note assembly having a tabbed note and fastener. The tabbed note has a first portion 1012 and a second portion 1016. The first portion extends or protrudes above a top of a sheet of paper when the tabbed note is fastened to the sheet of paper. A user may write information on the first portion for example to enable the sheet of paper to be readily identified. This information remains visible even when the sheet is in a stack with other sheets.

The second portion extends below the profile of the sheet of paper when the tabbed note is fastened to the sheet of paper. A user may make notations on the first portion. For example, a user may write notes regarding the sheet of paper on the first portion of the tabbed note.

The fastener allows the tabbed note to be relatively securely fastened to the sheet of paper, and the insertion of the fastener through an opening reduces the likelihood that the fastener and the tabbed note may become separated. In general, the opening may be positioned such that when the fastener is inserted through the opening and the tabbed note is fastened to one or more sheets of paper, the tab extends above the profile of one or more sheets of paper.

In another implementation of the invention, the second portion note may be behind the sheet of paper, and the fastener will be on top of the sheet. The fastener is arranged such that when the tabbed note assembly is fastened to the sheet, the fastener is effectively fastened about both the sheet and the tabbed note.

A tabbed note can have one or more colors. For example, a tabbed note can be red, orange, yellow, green, blue, purple, or any combination of these. In an implementation, the first portion is a first color and the second portion is a second color. The first portion and second portion may have different shades of a color.

Furthermore, the note can have a color scheme, which help facilitate the use of the note as an organization tool. In an implementation, there can be note sheets of different colors, so that different colors can be used for different purposes. In an implementation, an individual note sheet can have two different colors or two different shades of the same color. For example, the first portion is a first color shade, and the second portion is a second color shade.

The binder clip can have a color finish such as metallic silver, polished silver, black, pink, purple, yellow, orange, blue, green, or others.

Figure 11:
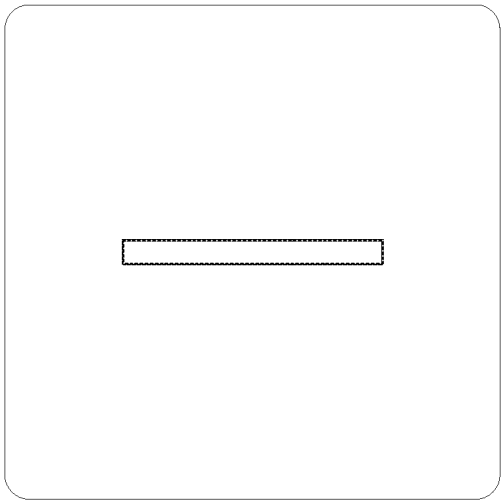
FIG. 11 shows a specific implementation of a tabbed note.

FIG. 11 shows a specific implementation of a tabbed note. The note sheet is rectangular, but can also be other shapes as discussed above. In an implementation, the note sheet is rectangular and has rounded corner on all four corners. In another implementation, the note sheet is square and has rounded corner on all four corners. In other implementation, the note sheet can have a combination of square and rounded corners, such as two upper rounded corners on a top edge of the sheet, and two lower square corners on a bottom edge of the sheet. In various implementations, a width-to-length aspect ratio of the rectangular sheet can be, for example, 1:1 (square), 1.19:1, 1.22:1, 1.08:1, 1.05:1, 1.04:1, 0.94:1, 0.92:1, 0.89:1. Other aspect ratios may be used.

The tabbed note has an opening. The opening should be large enough to allow the fastener to be inserted through it. This opening may be a hole or cutout. In the figure, the opening is a rectangular cutout. This is not intended to limit the invention. An opening may have various shapes, sizes, or configurations. For example, in other implementations, the opening can other shapes including polygon, trapezoid, square, rectangle, circle, ellipse, rounded triangle, rounded rectangle, rounded square, or others. The opening is configured and sized to enable a desired fastener to be readily inserted therethrough. The length of the opening should be long enough to allow the fastener to be inserted through it. As discussed above, the location of the opening for the fastener may vary depending on the specific implementation of the invention.

To manufacture the tabbed note, the opening may be formed in the tabbed note using a single die cut or punch. Or the opening may be formed in multiple die cut or punch operations. The tabbed note assembly has been described as having one opening. This is not intended to limit the invention. The tabbed note assembly can have more than two openings. In an implementation, the tabbed note assembly has three openings, four openings, or five openings. The sizes of the openings are dependent upon the size of the binder clips. The bigger the binder clips, the bigger or longer the opening is, as well as the bigger the paper.

Figure 12:
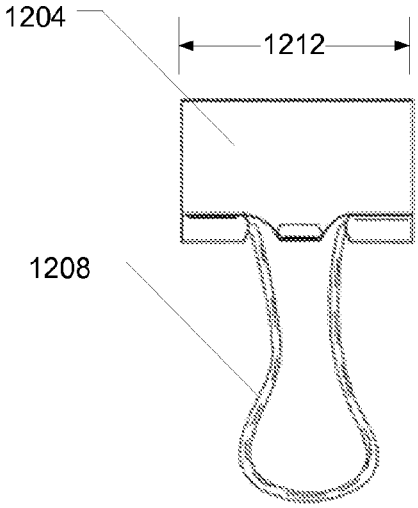
FIG. 12 shows a binder clip fastener having a binding portion and handles or clasps.
Figure 13:
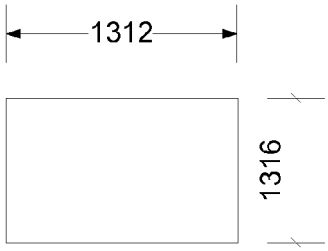
FIG. 13 shows a top view of the binder clip fastener.
Figure 14:
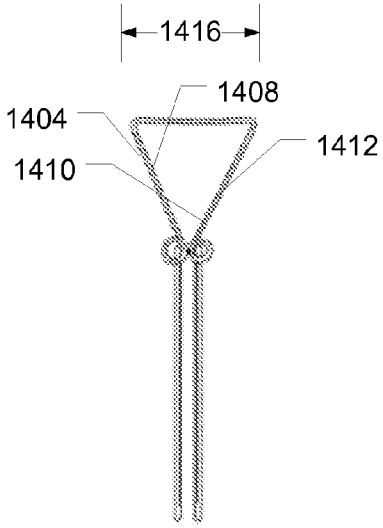
FIG. 14 shows a side view of the binder clip fastener.

FIGS. 12-14 show various views of a binder clip. A binder clip such as shown and described in U.S. Pat. No. 1,139,627, issued May 18, 1915, may be used. The handles of the binder clip can be flipped to an up position or down position. In the up position, the handles can be used to unclip or release the binder clip. In the down position, the handles can rest against papers to which the binder clip is binds. In an implementation, the handles can also be removed by squeezing them together and unlatching them from the clip. Other binder clip designs may also be used.

FIG. 12 shows a fastener having a binding portion 1204 and handles or clasps 1208. The binding portion has a length 1212 at a top of the binding portion. FIG. 13 shows a top view of the fastener. The top of the binding portion has a length 1312 and a width 1316. FIG. 14 shows a side view of the fastener. The fastener has a first side edge 1404, a second side edge 1408, a third side edge 1410, and a fourth side edge 1412. The first and second sides are opposite each other. The third and fourth sides are opposite each other. The second and third sides face each other.

Figure 15:
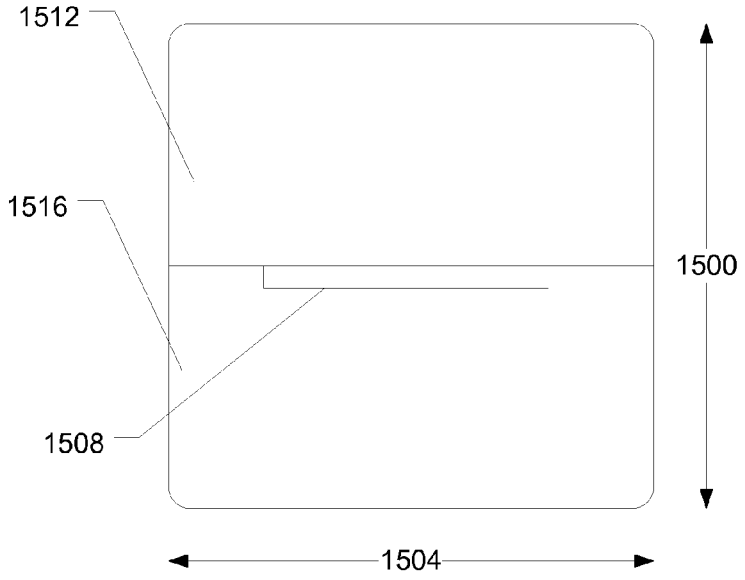
FIG. 15 shows a specific implementation of a tabbed note having an opening.

FIG. 15 shows a specific implementation of a tabbed note having an opening 1508. The tabbed note also has a first portion 1512 and a second portion 1516.

Between a bottom side and a top side of the tabbed note is a first distance 1500. Between a left side and a right side of the tabbed note is a second distance 1504.

The first and second distances may vary depending on how big a user desires the tabbed note to be.

The opening 1508 is made in the tabbed note along a first direction. Various means can be used to make an opening in the tabbed note. For example, in an implementation, a user uses scissors to create the opening. In another implementation, a knife is used to create the opening. In another implementation, a machine creates the incision to create the opening. In another implementation, a machine punches a hole in the tabbed note to create the opening.

Figure 16A:
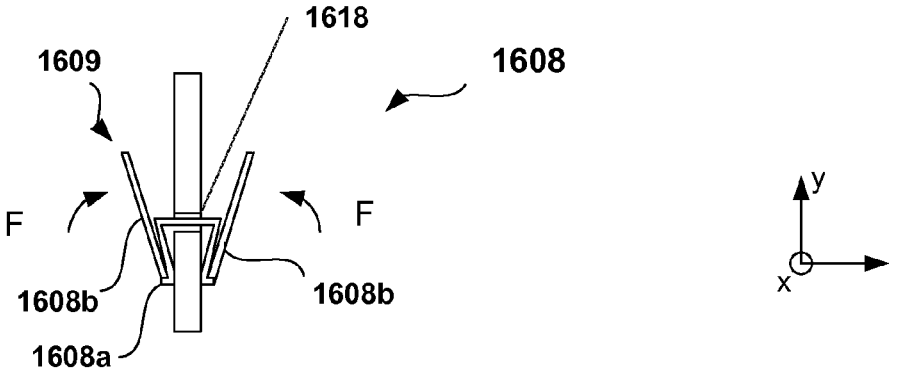
FIG. 16A shows a cross-sectional side view of the tabbed note assembly with a binder clip prior to the binder clip being fastened to a sheet of paper, in accordance with an embodiment of the present invention.
Figure 16B:
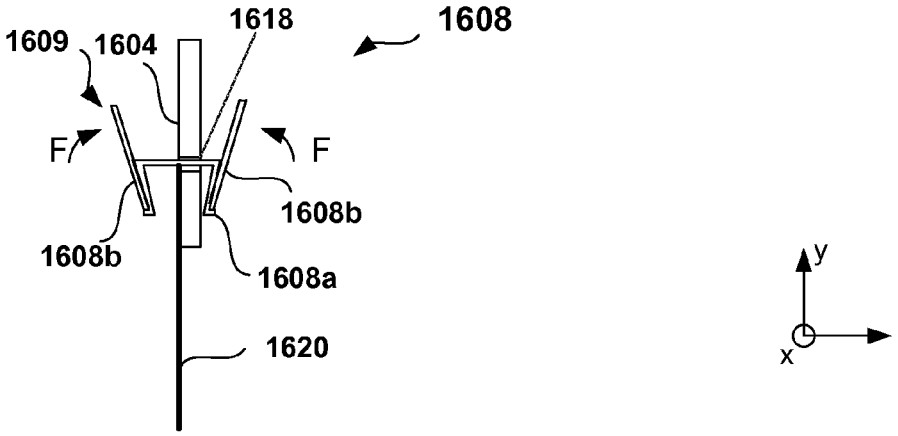
FIG. 16B shows a cross-sectional side view of the tabbed note assembly with a binder clip, i.e., binder clip 1108 of FIG. 11A, during a process of fastening the binder clip to a sheet of paper, in accordance with an embodiment of the present.
Figure 16C:
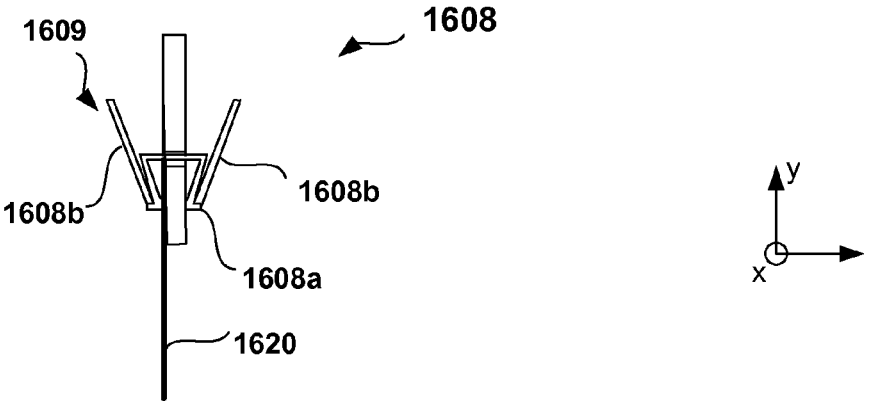
FIG. 16C is a cross-sectional side-view of the tabbed note assembly with a binder clip, after the binder clip is fastened to a sheet of paper, in accordance with an embodiment of the present invention

In a specific implementation, FIGS. 16A-16C show one method of using the tabbed note assembly which includes using a binder clip to tab a sheet of paper. FIG. 16A is a cross-sectional side-view of a tabbed note assembly 1608 in a closed, or clamped, position prior to being used to tab a sheet of paper. A binder clip 1609 which includes a flexible body 1608*a* and legs 1608*b* is positioned through an opening 1618 in a tabbed note. In the closed position, sides of the binder clip body contact a front and back of a tabbed note as shown in FIG. 16A. Legs 1608*b* are in a raised position such that when forces F of an appropriate magnitude are applied to legs, body 1608*a* effectively opens from the closed, or clamped position.

FIG. 16B is a cross-sectional side-view of the tabbed note assembly 1608 having a binder clip 1609 with body 1608*a* in an open position. When forces F are applied to legs 1608*b*, legs 1608*b* apply force on body 1608*a* and cause body 1608*a* to open. In the open position, as shown in FIG. 16B, a portion of the tabbed note 1604 closest to a top edge of the tabbed note extends beyond legs 1608*b*. Once body 1608*a* is open, a sheet of paper 1620 may be positioned within body 1608*a*. As shown, sheet of paper 1620 is thinner than tabbed note 1604, although it should be understood that the thickness of sheet of paper 1620 may vary widely. Additionally, while one sheet of paper 1620 has been shown, the number of sheets of paper 1620 which may be positioned within body 1608*a* may vary widely.

After sheet of paper 1620 is positioned within body 1608*a*, forces F may be removed from legs 1608*b*. The removal of forces F generally causes body 1608*a* to close, to return to the closed, or clamped position. The closure of body 1608*a* causes body 1608*a* to apply a clamping force on tabbed note 1604 and sheet of paper 1620 such that sheet of paper 1620 is held against tabbed note 1604, as shown in FIG. 11C.

Although binder clip 1608 may be used with legs 1608*b* in a raised or open position, positioning legs 1608*b* in a closed position lowers the overall profile of the tabbed note assembly.

Figure 17:
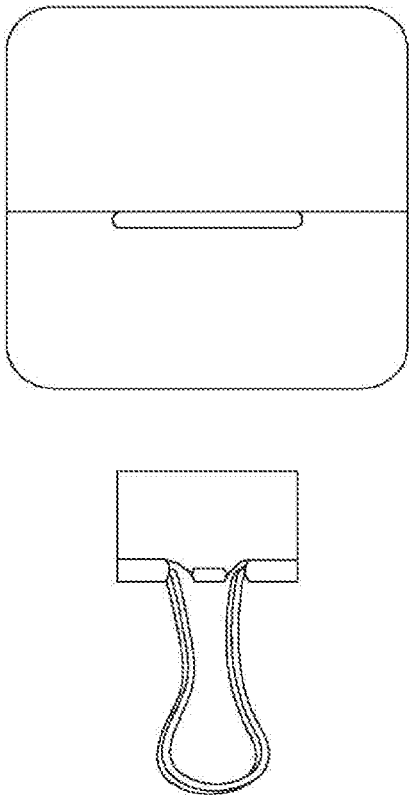
FIG. 17 shows a tabbed note assembly.

FIG. 17 shows a tabbed note assembly that has been disassembled. In a specific implementation, the tabbed note has a first note portion and a second note portion. The first note portion and the second note portion are defined by a different colored printing in these portions. The opening is centered horizontally between opposite left and right edges of the note. In another implementation, the opening is not centered between left and right edges of the tabbed note. In this implementation, the opening can be located closer to the first side or closer to the second side. In this specific implementation, the opening is positioned within the first note portion, but in other implementations, the opening can be positioned across the first and second note portions, or entirely within the second note portion. The width of the opening can have any desirable width.

Figure 18:
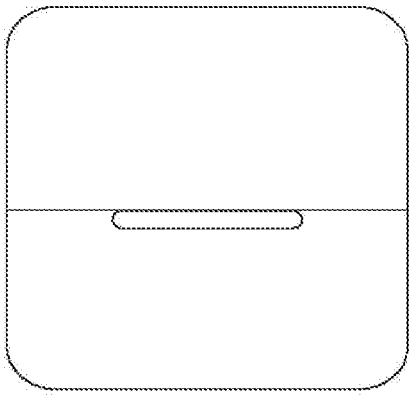
FIG. 18 shows a tabbed note having an opening.

FIG. 18 shows a more detailed view of the tabbed note having an opening. This shows an example of a specific implementation of a note sheet having two different colors or two different shades of the same color. For example, the top tab portion is a first color shade (e.g., bright pink), and the lower portion is a second color shade (e.g., light pink). In various other implementations, the color scheme are bright yellow-light yellow, bright orange-light orange, pink-light pink, bright purple-light purple, bright yellow-light yellow, bright red-light red, bright blue-light blue, and bright green-light green. And in other implementations, the note sheet can have various patterns and designs, on one or on both sides of the note.

Figure 19:
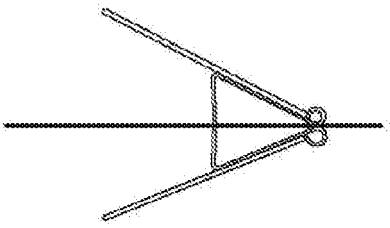
FIG. 19 shows a side view of a tabbed note assembly.

FIG. 19 shows a side view of a specific implementation of the tabbed note assembly with a binder clip. The legs of the binder clip are folded upward, away from each other.

Figure 20:
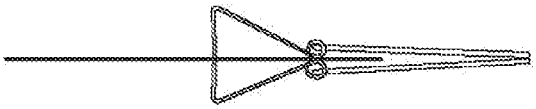
FIG. 20 shows another side view of a tabbed note assembly.

FIG. 20 shows another side view of a specific implementation of the tabbed note assembly with a binder clip. The legs of the binder clip are extended and fold toward each other to be in a closed position. When the legs are in the closed position, as shown in FIG. 20, the legs are such that one leg is in contact with a first side of the tabbed note while another leg is in contact with an opposite side of the tabbed note. The binder clip legs extend beyond a bottom edge of the tabbed note.

Figure 21:
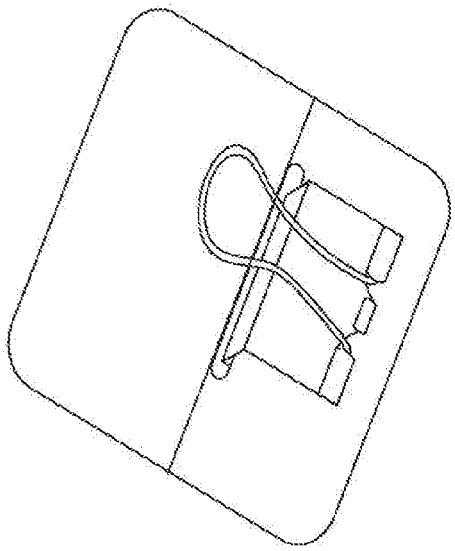
FIG. 21 shows a perspective view of a tabbed note assembly with handles or clasps positioned in an upward position.

FIG. 21 shows a perspective view of a specific implementation of the tabbed note assembly with a binder clip. The legs of the binder clip are folded upward, away from each other. A user can hold the legs of the binder clip between his or her fingers.

Tabbed note assemblies may be packaged together for sale. The tabbed note assemblies can be packaged in various arrangements to conserve space, as well as to maintain an orderly appearance inside a packaging container. In a specific implementation, one or more tabbed note assemblies are displayed in a side-by-side arrangement. This specific arrangement permits the tabbed note assemblies to remain neatly packaged and to ensure that a side of each tabbed note assembly remains fully visible to through the packaging container.

FIGS. 22A-22B show a specific implementation of a strip for attaching a series of tabbed note assemblies. This permits the tabbed note assemblies to be displayed in a side-by-side arrangement. FIG. 22A shows a first set of tabbed note assemblies attached to a first strip 2201*a*. FIG. 22B shows a second set of tabbed note assemblies attached to a second strip 2201*b*. In this specific implementation, three tabbed note assemblies are attached to each strip. In this implementation, the strip is a piece of material onto which one or more fasteners of a tabbed note assembly can attach. If more than one tabbed note assemblies are attached, each can be positioned on the material such that one edge of a tabbed note touches an edge of an adjacent tabbed note. In this manner, more than one tabbed note assemblies can be held in place together as a unit. It should be appreciated that the strip of material is not limited to a rectangular shape as shown in FIGS. 22A-B. The shape can be another including polygonal (e.g., triangle, square, rectangle, or trapezoid) and curved shapes (e.g., circular or semicircular). The material of the strip may be formed from any suitable material. Materials include, but are not limited to, card stock, paper, plastic, rubber, polymer, polyester, animal skin, leather, natural fibers, cotton, linen, fabric, parchment, Mylar®, or vellum. Mylar is a trademark of E.I. du Pont de Nemours and Company.

FIGS. 23A-23C show a more detailed view of a specific implementation of the strip. In this arrangement, three tabbed note assemblies can be attached in a side-by-side arrangement. In other implementations, fewer or greater number of tabbed note assemblies can be so arranged. FIG. 23A shows the tabbed note of a disassembled tabbed note assembly. FIG. 23B shows a specific implementation of the strip. FIG. 23C shows the binder clip of a disassembled tabbed note assembly.

Figure 24:
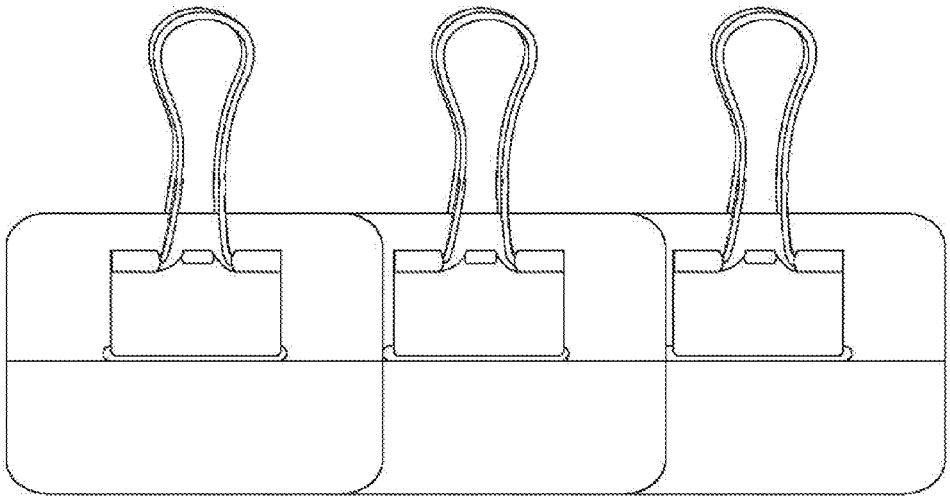
FIG. 24 shows a perspective view of a specific implementation of attaching a series of tabbed note assemblies to a strip.

FIG. 24 shows a perspective view of a specific implementation of a strip of material for holding an arrangement of tabbed note assemblies (strip not visible). It may be desirable to arrange more than one tabbed note assembly in an overlapping arrangement, in order to conserve space or to display a more visually pleasing arrangement than a side-by-side arrangement, as shown in FIGS. 22A-B. A manufacturer, retailer or a user may control the amount of overlap between each tabbed note, as desired. Furthermore, the direction of overlap can be controlled. For example, if two tabbed note assemblies are arranged in an overlapping arrangement, the one on a right side may overlap an edge of the one on a left side, such that the right one is fully visible. By contrast, the left one can be arranged to overlap the right one.

Figure 25:
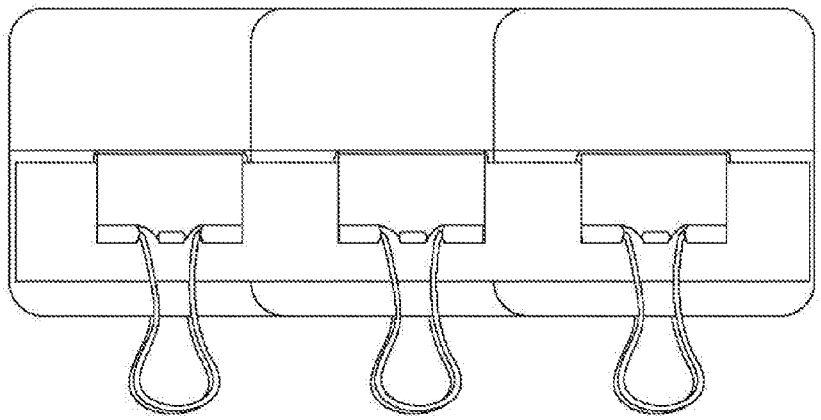
FIG. 25 shows a rear view of a specific implementation of attaching a series of tabbed note assemblies to a strip.

FIG. 25 shows a back view of a specific implementation of a strip for holding an arrangement of tabbed note assemblies in an overlapping arrangement.

Embodiments of the invention may have varying tabbed note dimensions, opening lengths, opening widths, described distances, and configurations. FIGS. 26A-B show a specific implementation of a tabbed note in accordance with an embodiment of the present invention. FIG. 26A shows the packaging for this implementation, where tabbed notes are arranged in a compartment 2601 of a container 2603. There are nine tabbed note assemblies. A first set 2605*a* of three tabbed notes are closest to an inner surface of the compartment, a second set 2605*b* of three tabbed notes is behind the first set, and a third set 2605*c* of three tabbed notes is behind the second set.

As discussed above, the tabbed notes can be fastened to strips. Each set of three tabbed note assemblies can be attached in a side-by-side arrangement to a strip. In this specific implementation, the package includes first, second, and third strips, where the first set of tabbed notes is attached to the first strip, the second set to the second strip, and the third set to the third strip. The first, second, and third strips are positioned behind the tabbed notes, and may not be visible from an outside of the container.

FIG. 26B shows the dimensions of this implementation of the tabbed note assembly. The tabbed note has a first portion or tab portion 2604 and a second portion or bottom portion 2608. A width 2612 between a left side of the tabbed note and a right side of the tabbed note is approximately 32-33 millimeters. A length 2616 between a top side of the tabbed note and a bottom side of the tabbed note is approximately 35-36 millimeters. A distance between a bottom side of the tabbed note and where the bottom and tab portions meet is approximately 15.5 millimeters. A length 2620 of the opening is approximately 16 millimeters. A width of the opening is approximately 2-3 millimeters. In this implementation, the opening is cut just under the point where the bottom portion and top portions meet. A thickness (not visible in FIG. 26B) of the tabbed note is approximately 0.5 millimeters.

FIGS. 27A-27B show another specific implementation of a tabbed note in accordance with an embodiment of the present invention. FIG. 27A shows the packaging for this implementation, where tabbed notes are arranged in a compartment 2701 of a container 2703. FIG. 27B shows the dimensions of this implementation of the tabbed note assembly. The tabbed note has a first portion or tab portion 2704 and a second portion or bottom portion 2708. A width 2712 between a left side of the tabbed note and a right side of the tabbed note is approximately 40 millimeters. A length 2716 between a top side of the tabbed note and a bottom side of the tabbed note is approximately 37-38 millimeters. A distance between a bottom side of the tabbed note and where the bottom and tab portions meet is approximately 18 millimeters. A length 2720 of the opening is approximately 20 millimeters. A width of the opening is approximately 2-3 millimeters. In this implementation, the opening is cut just under the point where the bottom portion and top portions meet. A thickness (not visible in FIG. 27B) of the tabbed note is approximately 0.5 millimeters.

FIGS. 28A-28B show another specific implementation of a tabbed note in accordance with an embodiment of the present invention. FIG. 28A shows the packaging for this implementation, where tabbed notes are arranged in a compartment 2801 of a container 2803. FIG. 28B shows the dimensions of this implementation of the tabbed note assembly. The tabbed note has a first portion or tab portion 2804 and a second portion or bottom portion 2808. A width 2812 between a left side of the tabbed note and a right side of the tabbed note is approximately 50 millimeters. A length 2816 between a top side of the tabbed note and a bottom side of the tabbed note is approximately 41-42 millimeters. A distance between a bottom side of the tabbed note and where the bottom and tab portions meet is approximately 21.5 millimeters. A length 2820 of the opening is approximately 26 millimeters. A width of the opening is approximately 2-3 millimeters. In this implementation, the opening is cut just under the point where the bottom portion and top portions meet. A thickness (not visible in FIG. 28B) of the tabbed note is approximately 0.5 millimeters.

The following applications are incorporated by reference: U.S. patent application Ser. No. 12/862,990, filed May 24, 2012; U.S. patent application Ser. No. 13/231,747, filed Sep. 13, 2011; U.S. provisional patent application 61/382,381, filed Sep. 13, 2010; U.S. patent application Ser. No. 12/973,720, filed Dec. 20, 2010; U.S. patent application Ser. No. 11/534,625, filed Sep. 22, 2006, issued as U.S. Pat. No. 7,857,127 on Dec. 28, 2010; U.S. provisional patent application 60/596,458, filed Sep. 23, 2005; U.S. design patent application 29/243,774 and 29/243,730, filed on Nov. 29, 2005; 29/246,502, 29/246,503, and 29/246,504, filed Apr. 19, 2006; 29/247,938, filed Jul. 20, 2006; 29/247,962, filed Jul. 21, 2006; and 29/248,033, filed Jul. 26, 2006.

This description of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications. This description will enable others skilled in the art to best utilize and practice the invention in various embodiments and with various modifications as are suited to a particular use. The scope of the invention is defined by the following claims.

The invention claimed is:

1. A tabbed note assembly comprising:

a tabbed note comprising:

an upper edge;

a lower edge opposite to the upper edge;

a first side edge;

a second side edge opposite the first side edge; and an opening between the first side edge and the second side edge; and a binder clip comprising a binder clip body and binder clip legs, the binder clip arranged to be positioned through the opening such that sides of the binder clip contact a front exterior surface and a back exterior surface of the tabbed note when the binder clip is in a closed position, wherein the binder clip legs extend beyond a bottom edge of the tabbed note assembly when the binder clip is in the closed position, wherein the binder clip legs can be rotated to an open position, wherein the opening extends from the front exterior surface to the back exterior surface of the tabbed note, and a first distance, between the opening and the lower edge of the tabbed note, is less than a length of a binder clip leg.

2. The tabbed note of claim 1 wherein the opening comprises an opening length in a first direction and an opening width in a second direction that is transverse to the first direction, the opening length is longer than the opening width, and the opening width is less than a width of the binder clip body in the second direction.

3. The tabbed note assembly of claim 2 wherein a portion of the tabbed note closest to the upper edge extends beyond the binder clip legs when the binder clip is in the open position.

4. The tabbed note assembly of claim 1 wherein the opening has a rectangular shape.

5. The tabbed note assembly of claim 1 wherein the tabbed note comprises only a single sheet.

6. The apparatus of claim 1 wherein the opening in the tabbed note comprises a length-to-width ratio in a range from about 5.33:1 to about 8:1.

7. The apparatus of claim 1 wherein the opening in the tabbed note comprises a length-to-width ratio in a range from about 6.66:1 to about 10:1.

8. A kit comprising:

a container, the container having at least one compartment;

a first plurality of tabbed note assemblies, the first plurality of tabbed note assemblies including a first tabbed note assembly having a first tabbed note and a first fastener, the first tabbed note having a first tab portion and a first note portion, the first note portion being approximately rectangularly shaped, the first tabbed note having a first opening defined therein through which the first fastener is inserted, wherein the first plurality of tabbed notes is positioned at least partially in the at least one compartment, the first fastener has a first body portion and first legs portion, the first legs portion extends beyond a first bottom edge of the first tabbed note when the first fastener is in a down position, the first legs portion can be rotated to an open position, the first opening extends from a front exterior surface of the tabbed note to a back exterior surface, opposite of the front exterior surface, of the tabbed note, and a first distance, between the first opening and a lower edge of the first tabbed note, is less than a length of the first legs portion; and a second plurality of tabbed note assemblies, the second plurality of tabbed note assemblies including a second tabbed note assembly having a second tabbed note and a second fastener, the second tabbed note having a second tab portion and a second note portion, the second note portion being approximately rectangularly shaped, the second tabbed note having a second opening defined therein through which the second fastener is inserted, wherein the second plurality of tabbed notes is positioned at least partially in the at least one compartment.

9. The kit of claim 8 further including:

a third plurality of tabbed note assemblies, the third plurality of tabbed note assemblies including a third tabbed note assembly having a third tabbed note and a third fastener, the third tabbed note having a third tab portion and a third note portion, the third note portion being approximately rectangularly shaped, the third tabbed note having a third opening defined therein through which the third fastener is inserted, wherein the third plurality of tabbed notes is positioned at least partially in the at least one compartment.

10. The kit of claim 9 wherein the third plurality of tabbed note assemblies is attached by a third strip, wherein the third tabbed note attaches to the third strip by the third fastener.

11. The kit of claim 8 wherein the first plurality of tabbed note assemblies has a first color scheme and the second plurality of tabbed note assemblies has a second color scheme.

12. The kit of claim 11 wherein the first color scheme includes a first shade of a first color and a second shade of the first color, the first note portion being of the first shade of the first color and the first tab portion being of the second shade of the first color, and wherein the second color scheme includes a first shade of the second color and a second shade of the second color, the second note portion being of the first shade of the second color and the second tab portion being of the second shade of the second color.

13. The kit of claim 8 wherein the opening is defined in the note portion and the tab portion is above the opening.

14. The kit of claim 8 wherein the first plurality of tabbed note assemblies is attached by a first strip, wherein the first tabbed note attaches to the first strip by the first fastener, and wherein the second plurality of tabbed note assemblies is attached by a second strip, wherein the second tabbed note attaches to the second strip by the second fastener.

15. The kit of claim 8 wherein the first and second fasteners comprise binder clips.

16. An apparatus comprising:

a rectangular card comprising an elongated slit opening, wherein above the elongated slit opening, the card comprises a first color and below the elongated slit opening, the card comprises a second color;

a binder clip comprising foldable handles, inserted through the slit opening, wherein the slit opening has a slit opening width that is longer than a slit opening length, and the slit opening width is wider than a width of the binder clip, a bottom edge of the binder clip clips to a contact point below the slit, a first length of the card above the contact point is longer than a length of the handles of the binder clip, the binder clip foldable handles can be rotated to an open position, the slit opening extends from a front exterior surface of the rectangular card to a back exterior surface, opposite the front exterior surface, of the rectangular card, the binder clip foldable handles extend beyond a lower edge of the rectangular card when the binder clip is in a closed position, and a second length of the card, between the slit opening and the lower edge of the rectangular card, is less than a length of a binder clip handle.

17. The apparatus of claim 16 wherein the binder clip comprises a clip body extending from a top of the binder clip to a top of the foldable handles, the handles extend from the top of the handles to a bottom of the handles, and the slit opening length is less than a length of the binder clip body.

18. The apparatus of claim 16 wherein the second color is a different hue than the first color.

19. The apparatus of claim 16 wherein the rectangular card comprises only a single sheet.

20. The apparatus of claim 16 wherein the elongated slit opening passes entirely through the rectangular card.

* * * * *